US006181072B1

(12) United States Patent
Leslie et al.

(10) Patent No.: US 6,181,072 B1
(45) Date of Patent: Jan. 30, 2001

(54) APPARATUS AND METHODS FOR DIMMING GAS DISCHARGE LAMPS USING ELECTRONIC BALLAST

(75) Inventors: Alexander D. Leslie, Waterloo (CA); Dean Heesung Cha, Fullerton; Allen Wong Yung, Los Angeles, both of CA (US)

(73) Assignee: EZ Lighting, LLC, Walnut, CA (US)

( * ) Notice: Under 35 U.S.C. 154(b), the term of this patent shall be extended for 0 days.

(21) Appl. No.: 08/865,750

(22) Filed: May 29, 1997

(51) Int. Cl.[7] ..... H05B 41/39

(52) U.S. Cl. ..... 315/194; 315/297; 315/DIG. 4

(58) Field of Search ..... 315/291, 292, 315/293, 294, 297, 307, 308, DIG. 4, 194

(56) References Cited

U.S. PATENT DOCUMENTS

| | | | | |
|---|---|---|---|---|
| 3,935,505 | | 1/1976 | Spiteri | 315/194 |
| 4,277,728 | | 7/1981 | Stevens | 315/307 |
| 4,350,935 | | 9/1982 | Spira et al. | 315/291 |
| 4,482,844 | * | 11/1984 | Schweer et al. | 315/194 |
| 4,604,552 | | 8/1986 | Alley et al. | 315/176 |
| 4,651,060 | | 3/1987 | Clark | 315/199 |
| 4,663,569 | | 5/1987 | Alley et al. | 315/175 |
| 4,701,680 | | 10/1987 | Alley et al. | 315/287 |
| 4,899,088 | | 2/1990 | Black, Jr. et al. | 315/291 |
| 4,947,079 | | 8/1990 | Black, Jr. et al. | 315/205 |
| 4,950,963 | | 8/1990 | Sievers | 315/360 |
| 5,004,972 | | 4/1991 | Roth | 323/320 |
| 5,107,184 | * | 4/1992 | Hu et al. | 315/291 |
| 5,138,234 | | 8/1992 | Miosin | 315/209 |
| 5,144,195 | | 9/1992 | Konopka et al. | 315/94 |
| 5,191,263 | | 3/1993 | Konopka | 315/209 |
| 5,194,781 | | 3/1993 | Konopka | 315/291 |
| 5,194,782 | | 3/1993 | Richardson et al. | 315/291 |
| 5,248,919 | | 9/1993 | Hanna et al. | 315/291 |
| 5,293,099 | | 3/1994 | Bobel | 315/225 |
| 5,373,218 | | 12/1994 | Konopka et al. | 315/291 |
| 5,500,575 | | 3/1996 | Ionescu | 315/307 |
| 5,585,699 | | 12/1996 | Schulz | 315/293 |
| 5,872,429 | * | 2/1999 | Xia et al. | 315/194 |

OTHER PUBLICATIONS

Stacy Kravetz, article entitled "Light Bulb Couldn't Match the Glow of Its Own Press", May 28, 1997, The Wall Street Journal.

* cited by examiner

*Primary Examiner*—David H. Vu
(74) *Attorney, Agent, or Firm*—J. Mark Holland & Associates

(57) ABSTRACT

Apparatus and method are provided for electronic ballasts control and dimming of gas discharge lamps such as fluorescent lamps. Conventional wiring is used, thereby permitting ready retrofit of existing installations. Circuits are provided in the electronic ballasts (typically in the lamp) and in a conventionally operated dimmer switch (typically installed on a wall). A user adjusts the dimmer switch in a conventional manner to achieve the desired level of dimming of the lamp. Such adjustments apply a corresponding control voltage in the dimmer switch circuit, causing a small notch to appear in the output voltage from the dimmer switch. The notch is demodulated by the circuitry in the ballast, and is used to control the brightness of the lamp or lamps.

5 Claims, 5 Drawing Sheets

APPARATUS AND METHODS FOR DIMMING GAS DISCHARGE LAMPS USING ELECTRONIC BALLAST

This invention relates to a system for dimming gas discharge lamps such as fluorescent lamps, using electronic ballasts and conventional wiring between the lamp and a conventionally-manipulated dimmer switch. More particularly, the invention relates to circuits in a dimmer switch and in an electronic ballast which can readily provide dimming by their retrofit into existing conventional fluorescent lamp installations, without the need for additional wiring between the dimmer switch and the lamp.

BACKGROUND OF THE INVENTION

The use of dimming apparatus in electric lighting, including gas discharge lamps, is well-known. Examples include two patents to Black, Jr., et al. (U.S. Pat. Nos. 4,947,079 and 4,899,088) which disclose circuits for providing dimming of fluorescent lights by creating "notches" in waveforms supplied by an alternating power source to a conventional inductive ballast. U.S. Pat. No. 4,663,569 to Alley et al. and U.S. Pat. No. 3,935,505 to Spiteri also show fluorescent lamp dimming systems which can be used in a retrofit manner with existing lamp ballasts. U.S. Pat. No. 4,350,935 to Spira and Richardson U.S. Pat. No. 5,194,782 illustrate other approaches to dimming gas discharge lamps.

Other technologies exist to "vary" the output of gas discharge lamps, without providing a full range of conventional dimming functions. Patents such as those to Konopka, et al. (U.S. Pat. Nos. 5,373,218 and 5,194,781) describe control circuits for fluorescent lamps, using a conventional two-position switch and conventional wiring, but only switching between two states—one "high energy" and one "low energy".

Certain other electronic ballasts (ballasts with built-in circuits) already exist to control the brightness of gas discharge lamp(s). These electronic ballasts are more energy efficient than conventional ballasts, and typically operate by changing the operating frequency of the ballast to maintain a current through the ballasts which is controlled by a reference voltage. Since there is typically an inductor in series with the lamp, increasing the frequency reduces the current to the lamp. The brightness of the lamp is therefore ultimately controlled by varying a reference voltage. Such an approach typically requires additional wiring and/or external circuitry, however, to vary the reference voltage in the ballast and thereby provide the necessary signal. Even for new construction, the costs of installation are increased because, among other things, of the need for the additional set of wires between the switch and the lamp(s). This approach also increases the expense, effort and time required for retrofit situations.

As indicated above, the foregoing and other prior art devices have various shortcomings. Certain of them use too much power, and/or are subject to short-circuiting. Many do not provide dimming over a desirably broad range of light output. Some require additional wiring between the switch and the lamp, thereby making them unsuitable for easy retrofits of existing installations.

OBJECTS AND ADVANTAGES OF THE INVENTION

It is, therefore, an object of the invention to provide an improved apparatus and method that controls dimming of a gas discharge lamp via conventional wiring between a switch and the lamp, using an electronic ballast member.

A further object of the invention is the provision of an apparatus and method of the foregoing character, including corresponding circuitry in a switch member to actuate the dimming function.

Another object of the invention is the provision of circuitry able to adjustably control the brightness of a fluorescent lamp or group of lamps from a single control point, using the wires which supply the power to the lamp(s). Among other things, these power supply wires can be the power wires used in existing, conventional fluorescent or gas discharge lamp installations.

An additional object of the invention is the provision of an electronic ballast system incorporating an internal control reference voltage which is used to set the current through the lamp(s) operated by the ballast. The circuitry of the invention permits the control reference voltage information to be conveyed through the power wires to the electronic ballast and processed there to cause the desired dimming control of the lamp(s).

A still further object of the invention is the provision of a method of retrofitting existing gas discharge lamp installations to provide a full range of dimming, by providing a dimming switch member capable of transmitting a notched signal along the power wire to the lamp, and providing a corresponding electronic ballast capable of demodulating the notched signal to thereafter adjustably control the brightness of the lamp.

Other objects and advantages of the invention will be apparent from the following specification and the drawings.

DESCRIPTION OF THE PREFERRED EMBODIMENT

Figure 1:
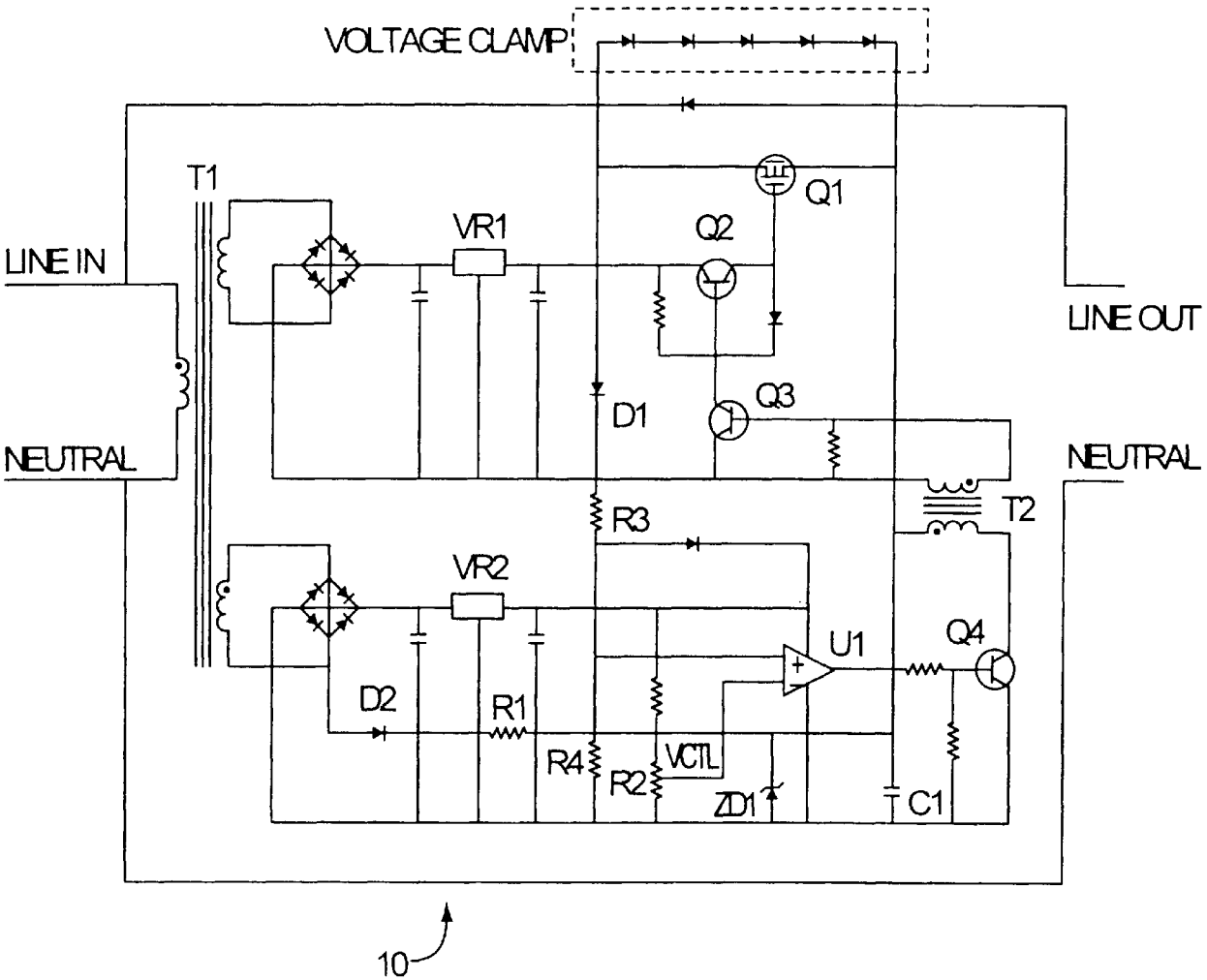
FIG. 1 shows a schematic circuit diagram of a preferred embodiment of a circuit useful in connection with the dimmer switch of the invention.
Figure 2:
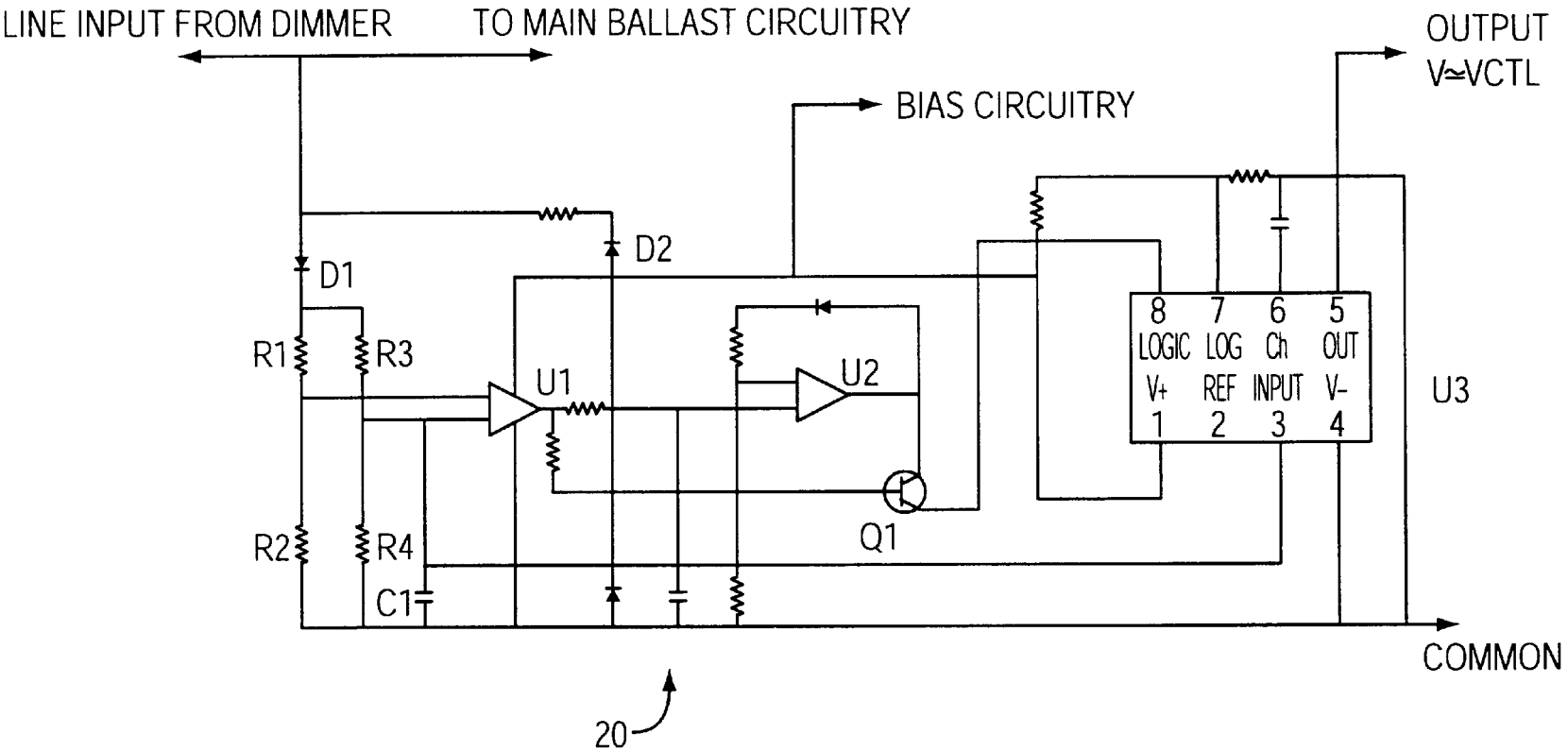
FIG. 2 shows a schematic circuit diagram of a preferred embodiment of a circuit useful in connection with the demodulating electronic ballast of the invention.
Figure 3:
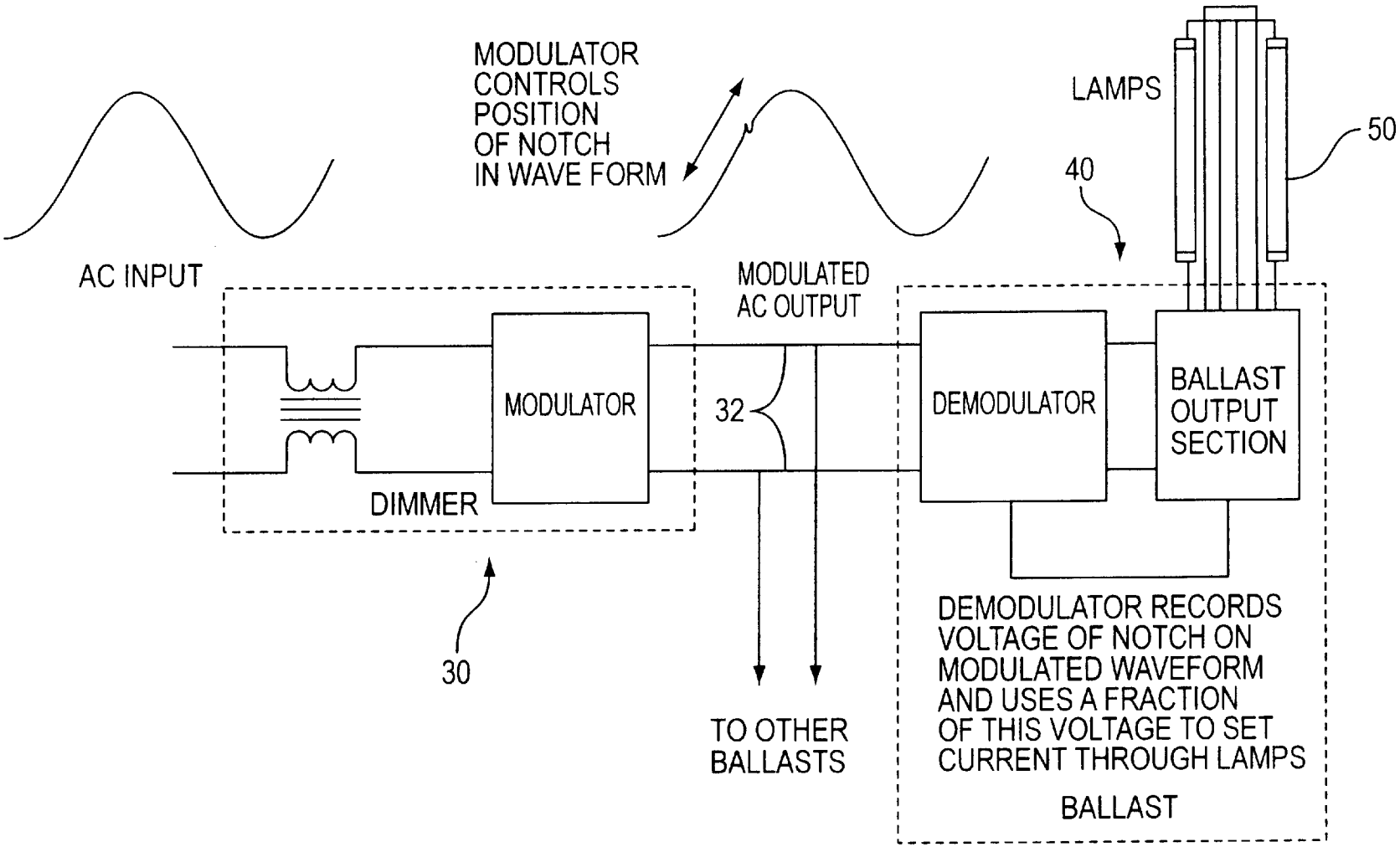
FIG. 3 is a block diagram illustrating an assembly of a dimmer switch of the invention operatively connected to a ballast of the invention, and thereafter to gas discharge lamps.

The drawings illustrate a preferred embodiment of the invention, including circuits for use in a dimmer switch control (FIG. 1) and for use in an electronic ballast (FIG. 2). As shown in FIG. 3, the preferred assembly of the invention includes a dimmer switch 30 of the invention (similar to FIG. 1) operatively connected to a ballast 40 of the invention (similar to FIG. 2), and thereafter to gas discharge lamps 50. FIG. 3 also illustrates that a single dimmer switch 30 can be used to control a plurality of ballasts 40 (although FIG. 3 only shows a single ballast 40).

As persons of ordinary skill in the art will readily understand, the circuits and assemblies of the invention may be fabricated from any suitable material and by any suitable process, and may be integrated into the associated dimmer switch and electronic ballast in any suitable manner.

As persons of ordinary skill in the art will further understand, as used herein the symbol Rx (as in R1, R2, R3, etc.) represents a resistor; Cx (as in C1, C2, etc.) represents a capacitor, Dx (as in D1, D2, etc.) represents a diode, Ux (as in U1, U2, etc.) represents a comparator, Tx (as in T1, T2, etc.) represents a transformer, and VRx (as in VR1, VR2, etc.) represents a voltage regulator.

In FIG. 1, the circuit 10 permits the control at the user end to mimic the operation of an ordinary incandescent "dimmer switch". For example, a sliding knob or other element (not shown) may be provided for the user to manipulate, sliding it toward one end of a slot to increase the brightness of the fluorescent lamp and toward the other to decrease the brightness. As discussed below, this adjustment and selection by the user correspondingly adjusts the resistance R2 in FIG. 1 to obtain the desired level of dimming.

Under normal operation of the circuit 10 of FIG. 1, the AC power on the "line" side of the AC power to the ballast all passes through a semiconductor switch Q1. In this case, the switch Q1 is shown as an N channel FET, although Q1 could be an IGBT, bipolar transistors, or any other suitable switch. Switch Q1 is preferably maintained in the on state by voltage to its gate, supplied through a transistor Q2.

Figure 1A:
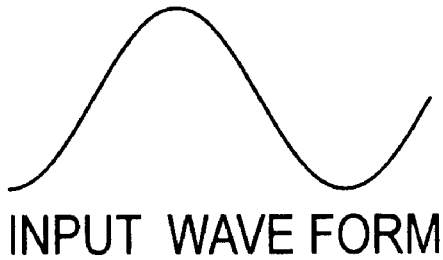
FIG. 1A illustrates a typical AC input waveform, as it is provided to the circuit of FIG. 1.

As indicated above, the user adjusts R2 to obtain the desired level of dimming. This adjustment results in a control voltage (Vctl) being applied to the negative input of the comparator U1. When the AC waveform on the "line" side of the AC supply reaches Vctl×(R3+R4)/R4, the output of U1 goes high. This causes Q4 to turn on, thereby discharging C1 through the primary of pulse transformer T2. This in turn results in transistor Q3 being turned on and Q2 being turned off and the gate of Q1 being discharged, turning Q1 off. When Q1 is off the voltage will drop by the value of the voltage clamp, which is shown in FIG. 1 as a string of diodes. Alternative embodiments of the voltage clamp would include, by way of example and not by way of limitation, a combination of zener diodes plus transistors or high power zener diodes. When C1 has been discharged (typically taking only several microseconds), Q3 will turn off, and once again Q1 will turn on and the circuit will resume operation normally. Only a small momentary dip in the voltage will appear, as illustrated in FIG. 1B (which should be compared to the normal input waveform of FIG. 1A).

All of the foregoing operation of the circuit 10 of FIG. 1 occurs only when the AC waveform on the "line" side of the AC power is greater than zero (i.e., positive). C1 is charged to a voltage limited by the Zener diode ZD1 through D2 and R1 only when the "line" side of the AC waveform is less than zero (i.e., negative). This is assured by the polarity arrangement of power transformer T1. Therefore, the circuitry will not attempt to recharge this capacitor more than once a cycle.

Figure 1B:
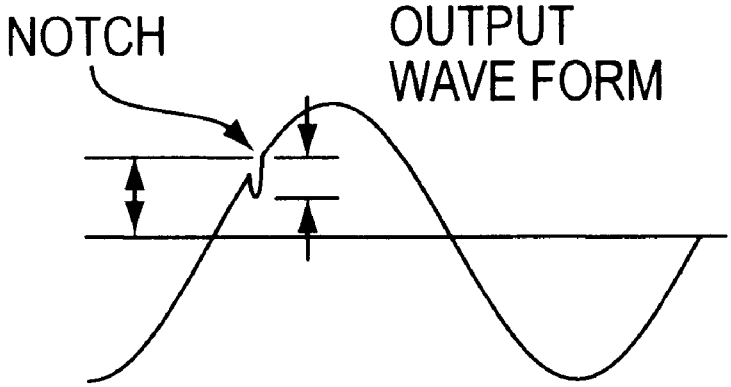
FIG. 1B illustrates a typical output waveform, as it is provided from the circuit of FIG. 1, including a notch on the rising edge of the sine wave.

As illustrated in FIG. 1B, the output of the "dimmer switch" of FIG. 1 is now a fairly normal AC sinusoidal waveform, with exception of a small notch of several volts at predetermined amplitude. The adjustable resistor R2 permits the user to select the amplitude and position of the notch on the AC waveform, as indicated by the arrows on FIG. 1B. This output is connected to the electronic ballasts (including preferably the circuitry shown in FIG. 2) via any suitable wiring arrangement (such as the central wiring 32 in FIG. 3), including conventional power wires such as are used to wire a conventional ballast to a conventional dimmer switch. If the particular ballasts are not configured to process the "notch" signal from the dimmer switch of FIG. 1, those ballasts will operate normally, at full brightness. If, however, the ballasts in the gas discharge lamp(s) are electronic ballasts that include the circuitry shown in FIG. 2 or its equivalent, the lamp(s) will be dimmed by the value of Vctl, as that Vctl was developed in the "dimmer switch" of FIG. 1.

Among other things, persons of ordinary skill in the art will understand that the voltage regulators VR1 and VR2 may be conventional regulators.

Turning now to FIG. 2, the output "line" side of the AC power illustrated in FIG. 1B is provided as supplying power to the main ballast circuitry (not shown in FIG. 2), and is also supplied to a "demodulator" circuit 20, a preferred embodiment of which is shown in FIG. 2. The "line" side power is supplied to two resistive dividers, one consisting of R1 and R2 and the other of R3 and R4, with the addition of C1 across R4. The dividers are essentially identical, but the addition of C1 causes two things to happen: (1) the waveform at the junction of R3, R4 has a phase delay (illustrated in FIG. 2A) compared to the waveform at the junction of R1, R2; and (2) the notch in the waveform is filtered at the junction R3, R4 (persons of ordinary skill in the art will understand that the filter is formed by R3, C1), reducing the "notch" at that point. Both of these waveforms or signals are fed to the comparator U1 of FIG. 2.

Figure 2A:
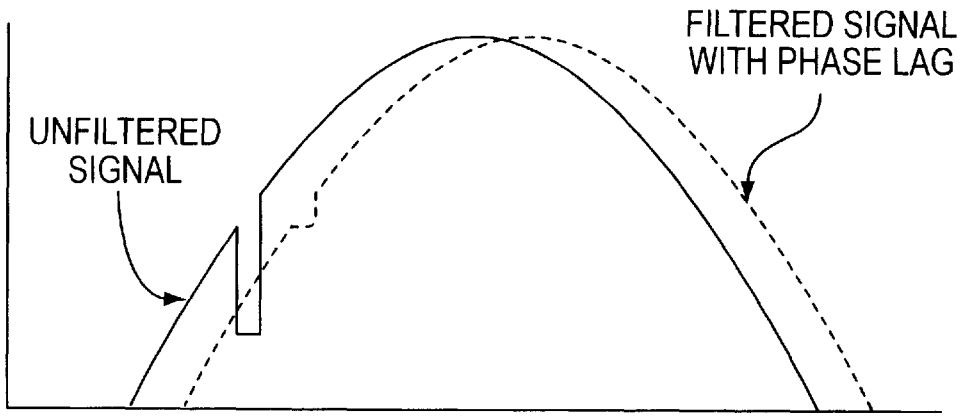
FIG. 2A illustrates the relationship of the unfiltered signal (such as provided by the output shown in FIG. 1B) to the filtered signal with phase lag provided in other portions of the circuit of FIG. 2.

As illustrated in FIG. 2A, the "notch" is detected when the unfiltered signal goes below the filtered signal. When the signal at the junction of R1, R2 of FIG. 2 drops below the signal at the junction R3, R4 (i.e., when the "notch" is detected), the output of the comparator U1 goes high, switching on the transistor Q1. If no "notch" is present or detected on the waveform, the voltage on the junction of R1, R2 will drop below the voltage on the junction of R3, R4 after the peak of the sine wave has been reached, resulting in a full brightness setting for the fluorescent lamp.

U3 of FIG. 2 is a sample and hold integrated circuit which is turned on by Q1. Therefore, when Q1 is turned on, the voltage at the junction of R3, R4 is sampled and held by U3 at its output. If R3, R4 in the demodulator circuit 20 of FIG. 2 are the same as R3, R4 in the "dimmer switch" circuit 10 of FIG. 1, the voltage at the output of the sample and hold circuit U3 will be "Vctl" from the "dimmer switch" circuit 10 of FIG. 1. This voltage can now be used to control the dimming function of the lamps, as will be readily understood by persons of ordinary skill in the art. For example, the control voltage may be used as a reference for a current error amplifier which compares it to the voltage derived from a current measurement.

Moreover, persons of ordinary skill in the art will understand that the system of the invention can be utilized adjustably select the brightness of the lamp from across a very broad range of power, from 100% of the lamp capacity down to approximately 10% of its capacity.

A preferred method of the invention includes retrofitting an existing electric light system to include a dimmable, electronic ballast gas discharge lamp. The steps include providing an electronic ballast of the aforementioned character, providing a dimmer switch of the aforementioned character, and installing both into an existing wired installation so that adjustment of the dimmer switch correspondingly dims or brightens the lamp.

Another method of the invention is similar, but is useful for new construction and installations. It includes providing an electronic ballast of the aforementioned character, providing a dimmer switch of the aforementioned character, and installing both along with installing wiring between those two elements, again so that adjustment of the dimmer switch correspondingly dims or brightens a lamp associated with the ballast.

The preferred embodiment of the invention thus combines the benefits of an electronic ballast with those of an adjustable, dimmable light. While the preferred embodiment and method of the invention has been described with some specificity, the description and drawings set forth herein are not intended to be delimiting, and persons of ordinary skill in the art will understand that various modifications may be made to the embodiments and methods discussed herein without departing from the scope of the invention, and all such changes and modifications are intended to be encompassed within the appended claims.

What is claimed is:

1. A circuit for demodulating a signal capable of dimming one or more gas discharge lamps, including a charge storing device for dividing a notched input signal into two waveforms, said waveforms being phase-delayed with respect to each other such that one waveform constitutes a leading waveform and the other waveform constitutes a lagging waveform, and said lagging waveform is filtered to virtually eliminate said notch whereby said circuit provides substantially continuous, non-discrete levels of adjustment of said lamps.

2. A system for dimming one or more gas discharge lamps, including the combination of a dimmer switch circuit capable of generating a notch in the positive side of an output AC waveform, said notch having an amplitude, said dimmer switch circuit also including means for preventing a corresponding notch from being formed on the negative side of said AC waveform, said combination further including at least one electronic ballast associated with said lamp, said electronic ballast configured to process said amplitude of said notch each cycle of said waveform to substantially instantly adjust the brightness of said lamp continuously within a given range of brightness, and a single power wire connecting said dimmer switch and said electronic ballast.

3. The system of claim 2, in which said one or more lamps are fluorescent lamps.

4. The system of claim 2 or claim 3, including a plurality of said electronic ballasts associated with a corresponding plurality of said lamps, the brightness of two or more of said lamps being controlled by said dimmer switch circuit.

5. A method of dimming gas discharge lamps, including the steps of:

providing operating power to one or more gas discharge lamps across a single power wire;

creating a voltage notch with an amplitude in an input power waveform;

transmitting said voltage notch with said power waveform across said single power wire to an electronic ballast of said one or more gas discharge lamps; and demodulating said amplitude of said voltage notch within one waveform cycle to substantially instantly control the output of said one or more gas discharge lamps.

* * * * *